US006009842A

United States Patent [19]

Hiereth

[11] Patent Number: 6,009,842

[45] Date of Patent: Jan. 4, 2000

[54] FUEL INJECTION SYSTEM FOR A MULTICYLINDER INTERNAL COMBUSTION ENGINE WITH A FUEL SUPPLY LINE SERVING AS A HIGH PRESSURE STORAGE DEVICE

[75] Inventor: Alexander Hiereth, Esslingen, Germany

[73] Assignee: DaimlerChrysler AG, Stuttgart, Germany

[21] Appl. No.: 09/173,387

[22] Filed: Oct. 15, 1998

[30] Foreign Application Priority Data

Oct. 16, 1997 [DE] Germany ..... 197 45 716

[51] Int. Cl.[7] ..... F01L 1/18; F01L 1/34

[52] U.S. Cl. ..... 123/90.27; 123/90.39

[58] Field of Search ..... 123/90.15, 90.16, 123/90.17, 90.27, 90.31, 90.39, 90.4

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,862,845 | 9/1989 | Butterfield et al. | 123/90.15 |
| 5,052,350 | 10/1991 | King | 123/90.16 |
| 5,178,105 | 1/1993 | Norris | 123/90.15 |
| 5,431,432 | 7/1995 | Kreuter et al. | 123/90.16 |
| 5,555,860 | 9/1996 | Wride | 123/90.16 |
| 5,586,527 | 12/1996 | Kreuter | 123/90.15 |
| 5,590,906 | 1/1997 | Kreuter et al. | 123/90.16 |

FOREIGN PATENT DOCUMENTS

| | | |
|---|---|---|
| 40 31 461 | 5/1991 | Germany . |
| 43 03 574 | 9/1993 | Germany . |
| 42 36 600 | 5/1994 | Germany . |
| 43 22 480 | 1/1995 | Germany . |
| 196 00 536 | 7/1997 | Germany . |

*Primary Examiner*—Weilun Lo
*Attorney, Agent, or Firm*—Klaus J. Bach

[57] ABSTRACT

In an arrangement for a variable control of the valves of an internal combustion engine having a cylinder head with two intake valves and one exhaust valve for each cylinder, a first cam shaft having an exhaust cam for actuating the exhaust valve and two intake valve opening cams arranged at opposite sides of the exhaust cam for opening the intake valves and a second camshaft which is phase adjustable with respect to the first camshaft and includes two intake valve closing cams operating an intake valve operating lever structure, the intake valve operating lever structure is U-shaped and has legs pivotally supported on an operating lever support shaft on which also an exhaust cam operating lever is pivotally supported between the legs of the U-shaped intake valve operating lever structure.

5 Claims, 9 Drawing Sheets

FUEL INJECTION SYSTEM FOR A MULTICYLINDER INTERNAL COMBUSTION ENGINE WITH A FUEL SUPPLY LINE SERVING AS A HIGH PRESSURE STORAGE DEVICE

BACKGROUND OF THE INVENTION

The invention relates to an arrangement for the variable control of the valves of an internal combustion engine including separate intake valve operating camshafts for opening and closing the intake valves and means for changing the phase relation between the two intake valve operating camshafts.

Such an arrangement is known for example from DE 196 00 536 A1. With such an arrangement, the exhaust gas emissions of an engine can be reduced and its torque can be increased. Also, the engine charge change losses and, as a result, the fuel consumption of the engine can be reduced. Furthermore, the engine can be controlled without a throttle valve in the air intake duct.

The arrangement includes two camshafts, a first one for controlling the exhaust valve and the opening of the intake valves and a second camshaft for controlling the closing of the intake valves. The intake cams for operating the intake valves include for each intake valve an intake valve opening cam on the first cam shaft and an intake valve closing cam on second camshaft which operate in an additive fashion. The control movement of the intake cams is transmitted to the intake valves by way of intake valve control levers. The control movement of the exhaust cams is transmitted to the exhaust valves by way of exhaust valve control levers. By means of an arrangement for changing the phase relation between the two camshafts the relative angle of rotation of the two camshafts can be changed so as to affect the opening movement and the opening duration of the intake valve.

The exhaust valve cams and the intake valve opening cams are arranged on the first camshaft axially one after the other so that at least one of the cams is arranged spaced from a plane extending normal to the camshaft and including the axis of one of the valves. The distance between the cam and the valve is bridged by a transmission lever. As a result, the contact point between the respective cam and the transmission lever is disposed outside the plane of movement of the transmission lever. Such an asymmetry, however, generates torque forces which may lead to early wear and which may detrimentally affect an accurate motion transmission.

It is the object of the present invention to provide an arrangement for the variable control of the valves of an internal combustion engine which operates highly reliably and which takes up only a relatively small space on the cylinder head.

SUMMARY OF THE INVENTION

In an arrangement for a variable control of the valves of an internal combustion engine having a cylinder head with two intake valves and one exhaust valve for each cylinder, a first cam shaft having an exhaust cam for actuating the exhaust valve and two intake valve opening cams arranged at opposite sides of the exhaust cam for opening the intake valves and a second camshaft which is phase adjustable with respect to the first camshaft and includes two intake valve closing cams operating an intake valve operating lever structure, the intake valve operating lever structure is U-shaped and has legs pivotally supported on an operating lever support shaft on which also an exhaust cam operating lever is pivotally supported between the legs of the U-shaped intake valve operating lever structure.

With the centrally arranged exhaust valve cam the motion transmission lever to the exhaust valve is short; the exhaust valve cam, the motion transmission lever and the exhaust valve are all disposed in a single plane and the forces effective on the components are all relatively small.

Particularly, the symmetrical arrangement of the two intake valve cams at opposite sides of the exhaust valve cam provides for a uniform loading of the inlet valve operating lever without any moments normal to the lever pivot axis. Also, the arrangement can be accommodated in a small space. With this arrangement, a valve control with two intake valves and one exhaust valve per cylinder and with a double ignition system can be realized in an efficient manner.

Further advantages and suitable embodiments will become apparent from the following description on the basis of the accompanying drawings.

DESCRIPTION OF PREFERRED EMBODIMENTS

Figure 1:
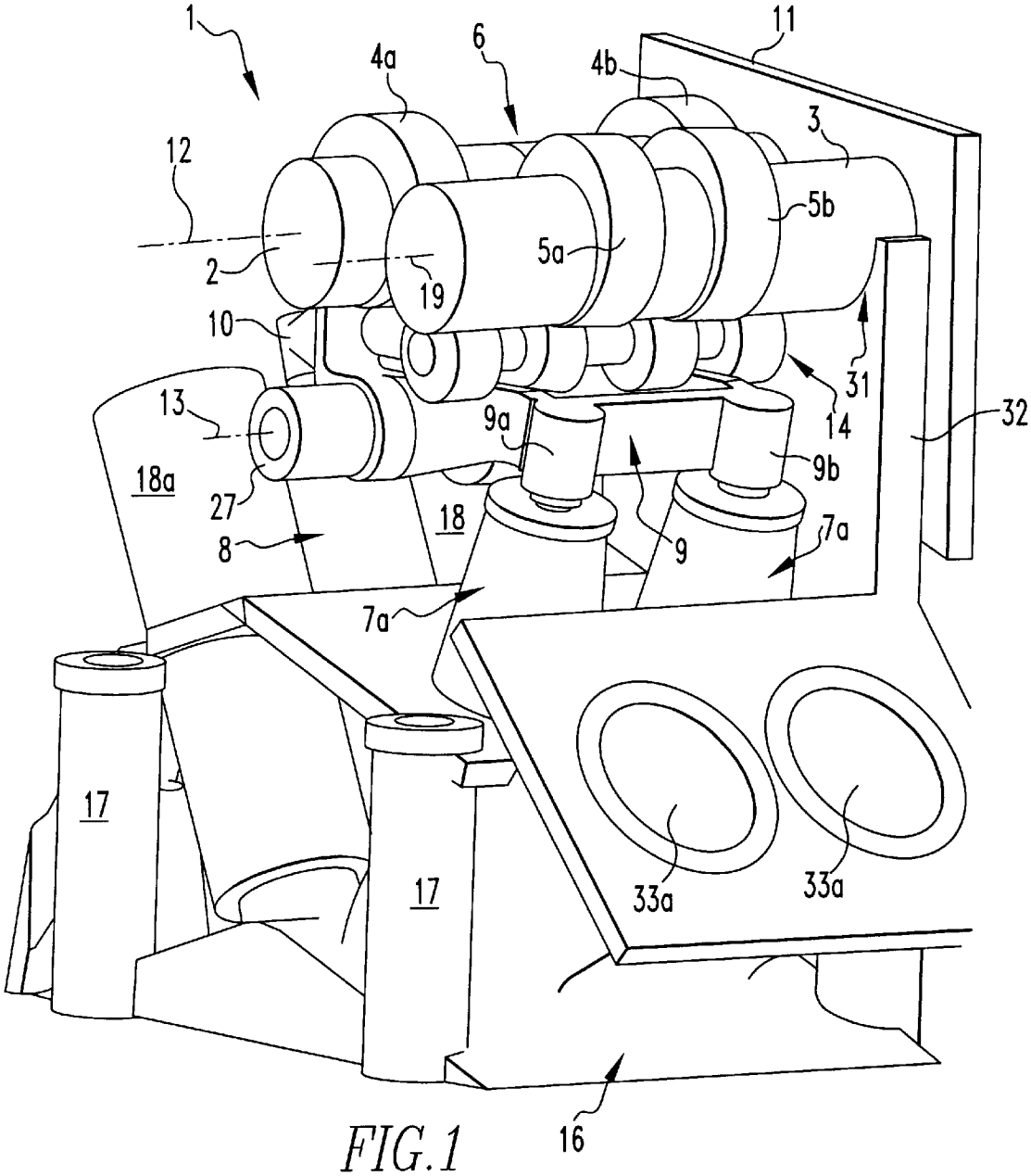
FIG. 1 is a perspective view of a cylinder head with a variable valve control.
Figure 2:
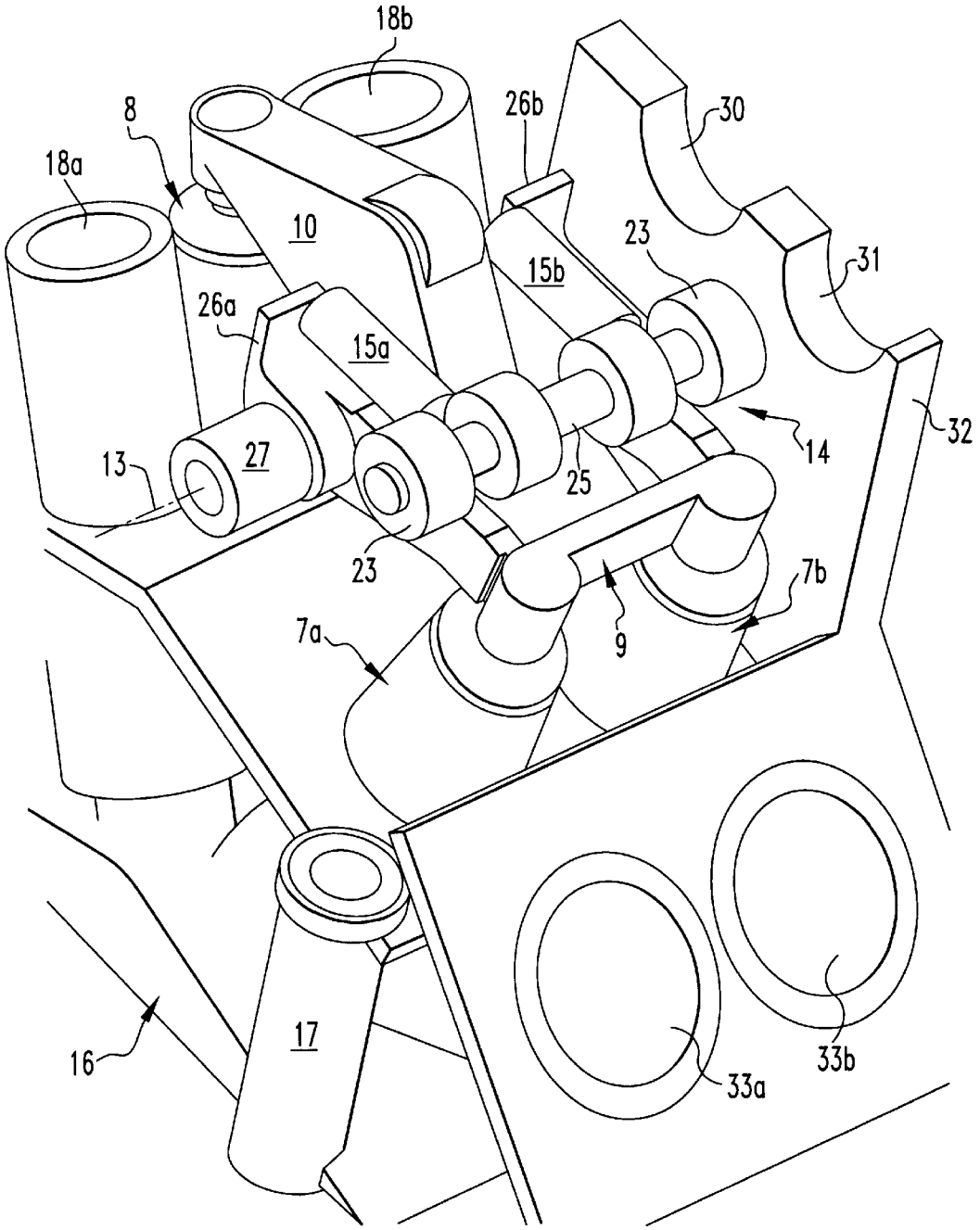
FIG. 2 shows the cylinderhead without camshafts.

The cylinder head 16, as shown in FIGS. 1 and 2 includes an arrangement 1 for variably controlling the valves of an internal combustion engine. The arrangement 1 comprises for each cylinder two parallel camshafts 2 and 3 disposed on top of the cylinder head 16 and having intake cams 4*a*, 4*b*, 5*a*, 5*b* and an exhaust cam 6. The camshafts 2, 3 are rotatably supported by bearings 30, 31, which are formed in a support portion 32. The control movement of the intake and exhaust cams is transferred to two intake valves 7*a*, 7*b*, and an exhaust valve 8 by an intake valve operation lever 9 and, respectively, an exhaust valve operating lever 10. FIGS. 1 and 2 show intake passages 33*a*, 33*b*, which are controlled by the intake valves 7*a*, 7*b*.

The intake cams 4*a*, 4*b*, 5*a*, 5*b* comprise four individual 15 cams. Two intake valve opening cams 4*a*, 4*b* are disposed on the first cam shaft 2 and two intake valve closing cams 5*a*, 5*b* are disposed on the second camshaft 3. The opening of the intake valves 7*a*, 7*b* is controlled by the intake valve opening cams 4*a*, 4*b* and the closing of the intake valves 7*a*, 7*b* is controlled by the intake valve closing cams 5*a*, 5*b*. The control movements of the intake valve opening cams and of the intake valve closing cams are superimposed in an additive fashion and are taken up by an engagement structure 14. The engagement structure 14 transfers the control movement to the intake valve operating lever 9 which includes two operating sections 9*a*, 9*b*.

The operating sections 9*a*, 9*b* which are integral parts of the intake valve operating lever 9 open and close the intake valves 7*a*, 7*b*. The engagement structure 14 comprises a roller shaft 25 and several rollers 23 disposed on the roller shaft 25. Each roller 23 is disposed in contact with the circumferential surface that is the camming surface of one of the individual cams 4*a*, 4*b*, 5*a*, 5*b*. The engagement structure 14 is biased by spring elements 15*a*, 15*b* which ensure that the engagement structure 14 is in contact with the intake valve cams. The spring elements 15*a*, 15*b* are supported on the support elements 26*a*, 26*b*, which are disposed on a hollow shaft portion 27. The intake valve operating lever 9 is also supported on the shaft portion 27 and pivots about the axis 13 of the shaft portion 27, which is parallel to the longitudinal axes 12, 19 of the camshafts 2, 3.

By means of a device 11 for changing the phase position of the two camshafts 2, 3 relative to each other, which is only schematically indicated in the drawings as it is well known, the opening movement and respectively, the opening duration of the inlet valves 7*a*, 7*b* can be changed. This arrangement makes it unnecessary to use a throttle valve in the intake channel of the internal combustion engine. The device is preferably a coupler drive, which is disposed between the two camshafts and by way of which the relative angle of rotation of the second camshaft 3 with respect to the first cam shaft 2 can be changed over a large angle. By the addition of the individual movements of the intake valve opening cams and the inlet valve closing cams, the opening duration, that is, the closing movement of the inlet valve can be changed by changing the relative phase positions of the two camshafts.

The exhaust cam 6 for controlling the exhaust valve 8 is disposed on the same camshaft 2 as the inlet valve opening cams 4*a*, 4*b*. The control movement is transferred directly to the exhaust valve operating lever 10 and the exhaust valve 8. The exhaust valve operating lever 10 is pivotally supported on the shaft 27 like the intake valve operating lever 9. The inlet valve opening cams 4*a*, 4*b* are arranged in axially spaced relationship from the exhaust cam 6 in the direction of the axis 12 of the first camshaft 2.

There are also provided two spark plug wells 18*a*, 18*b* for receiving the spark plugs of a double ignition system. The cylinder head 16 is mounted on an engine block by bolt mounts 17.

Figure 3:
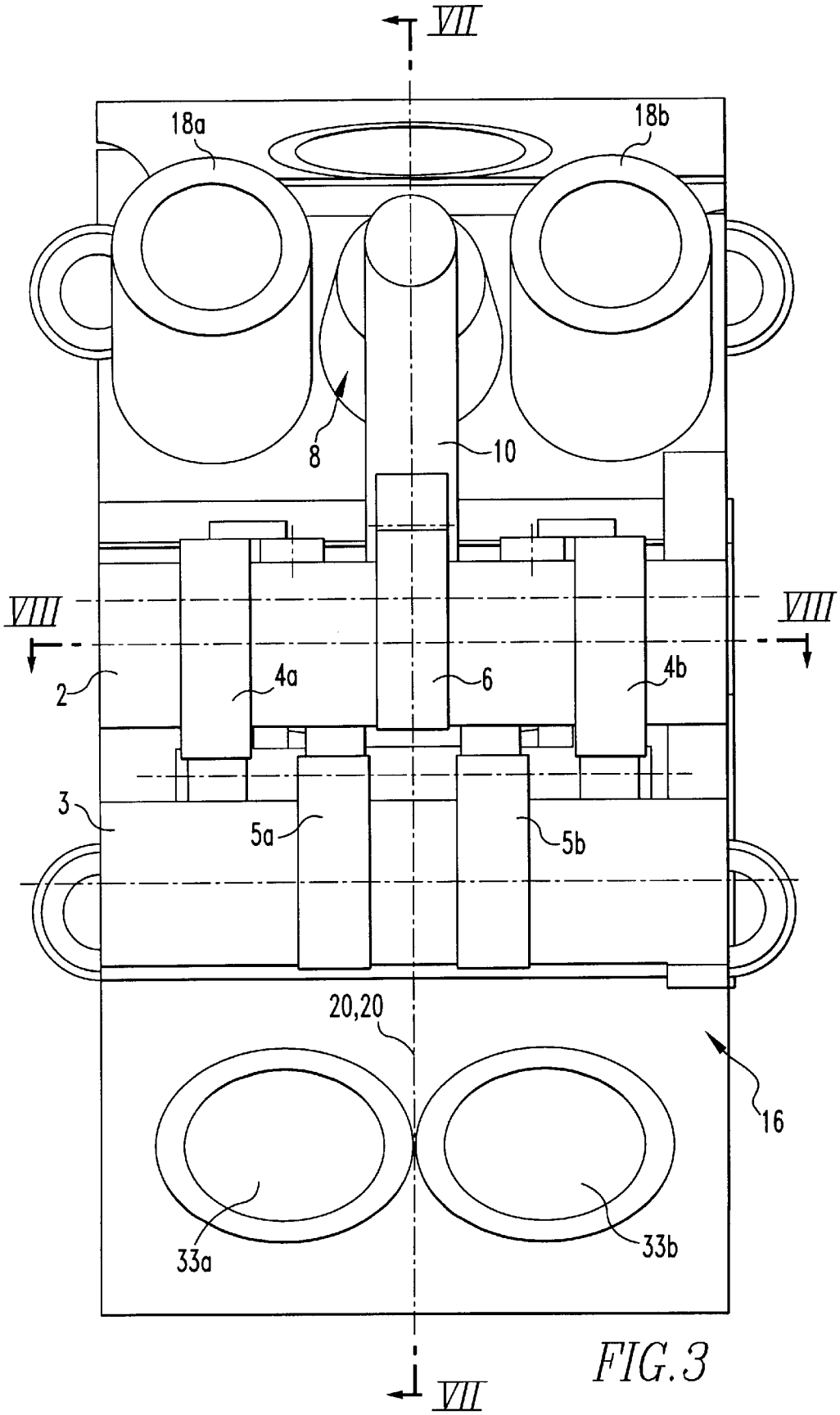
FIG. 3 is a top view of the cylinder head.

As can be seen from FIG. 3, the exhaust cam 6 is disposed on the first camshaft 2 in the middle of the cylinder head so that the radial center plane of the exhaust cam 6 coincides with the center plane 20 of a cylinder of the cylinder head 16. The center plane 20 is identical with the plane of movement 22 of the exhaust valve operating lever 10, which is reciprocated in the plane of movement 22 for operating the exhaust valve 8. The plane of movement 22 or, respectively, the center plane 20 forms at the same time a symmetry plane for the two intake passages 33*a*, 33*b* and the two spark plug wells 18*a*, 18*b* in the cylinder head 16. Also, the altogether four intake cams comprising two intake valve opening cams 4*a*, 4*b* on the first camshaft 2 and the two intake valve closing cams 5*a*, 5*b* on the second camshaft 3 are arranged symmetrical with respect to the center plane 20.

With the arrangement of the exhaust cam 6 in the plane of movement 22 of the exhaust valve operating lever 10, the mechanism can be relatively simple. Particularly, friction of the exhaust valve operating lever 10 on the shaft 27 can be reduced since the exhaust valve operating lever 10 is pivotally supported on the shaft 27 by only a single bearing. All the forces to be transmitted between the exhaust cam 6 and the exhaust valve 8 are disposed in the plane of movement 22. There are no torsion forces. The simple arrangement and the absence of torsion forces permits also a reduction of the moving masses whereby the forces effective during actuation of the exhaust valves are further reduced.

In the arrangement as shown in FIGS. 1 to 8, the distances between the intake valve opening cams 4*a*, 4*b* and the exhaust cam 6 are so selected that the inlet valve closing cams 5*a*, 5*b* can extend into the spaces between the inlet valve opening cams and the exhaust cams. Because of the large distance between the intake valve opening cams and the exhaust cam, manufacturing of the camshaft 2 is facilitated.

Figure 4:
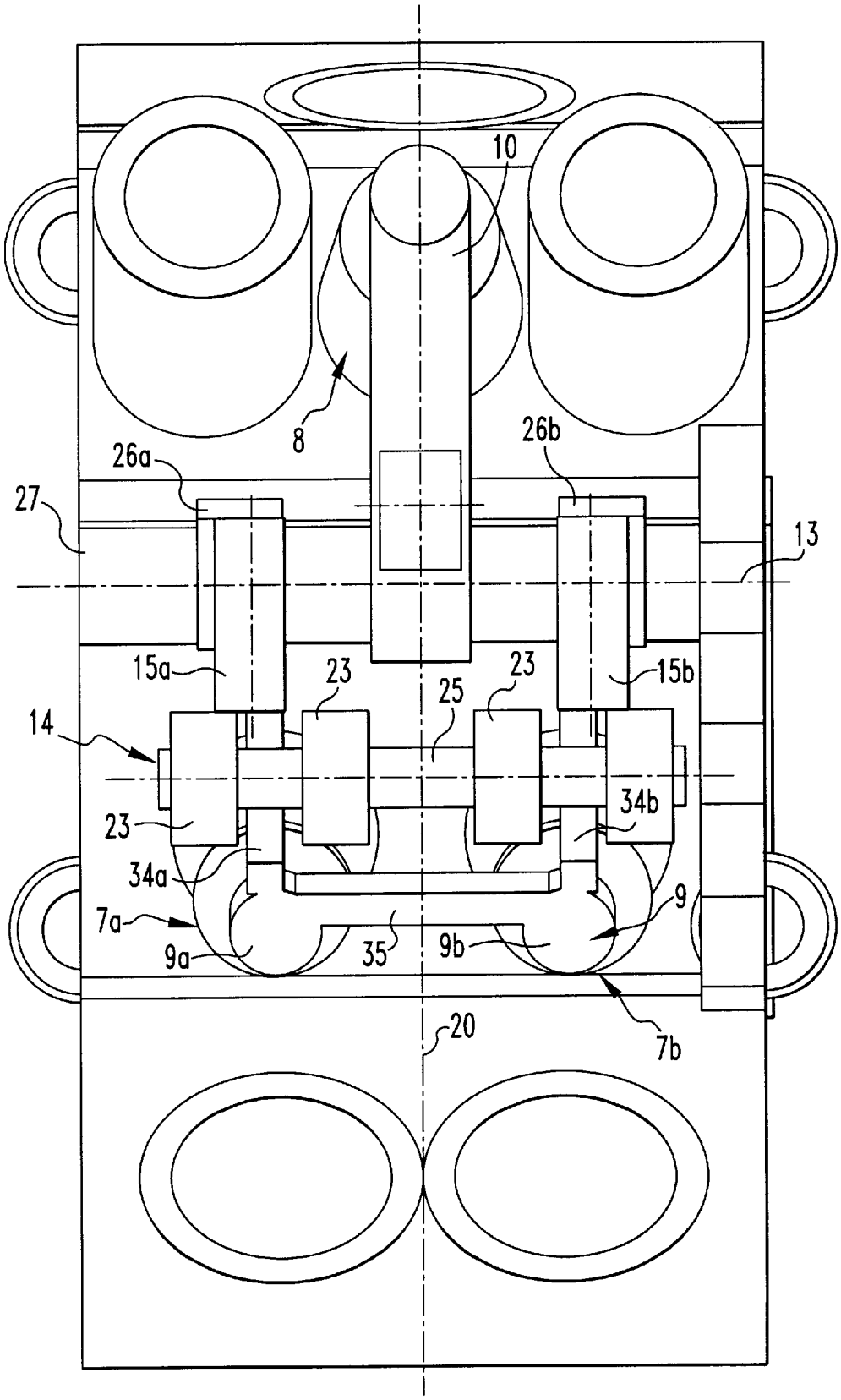
FIG. 4 is a top view corresponding to FIG. 3, however without camshafts.
Figure 5:
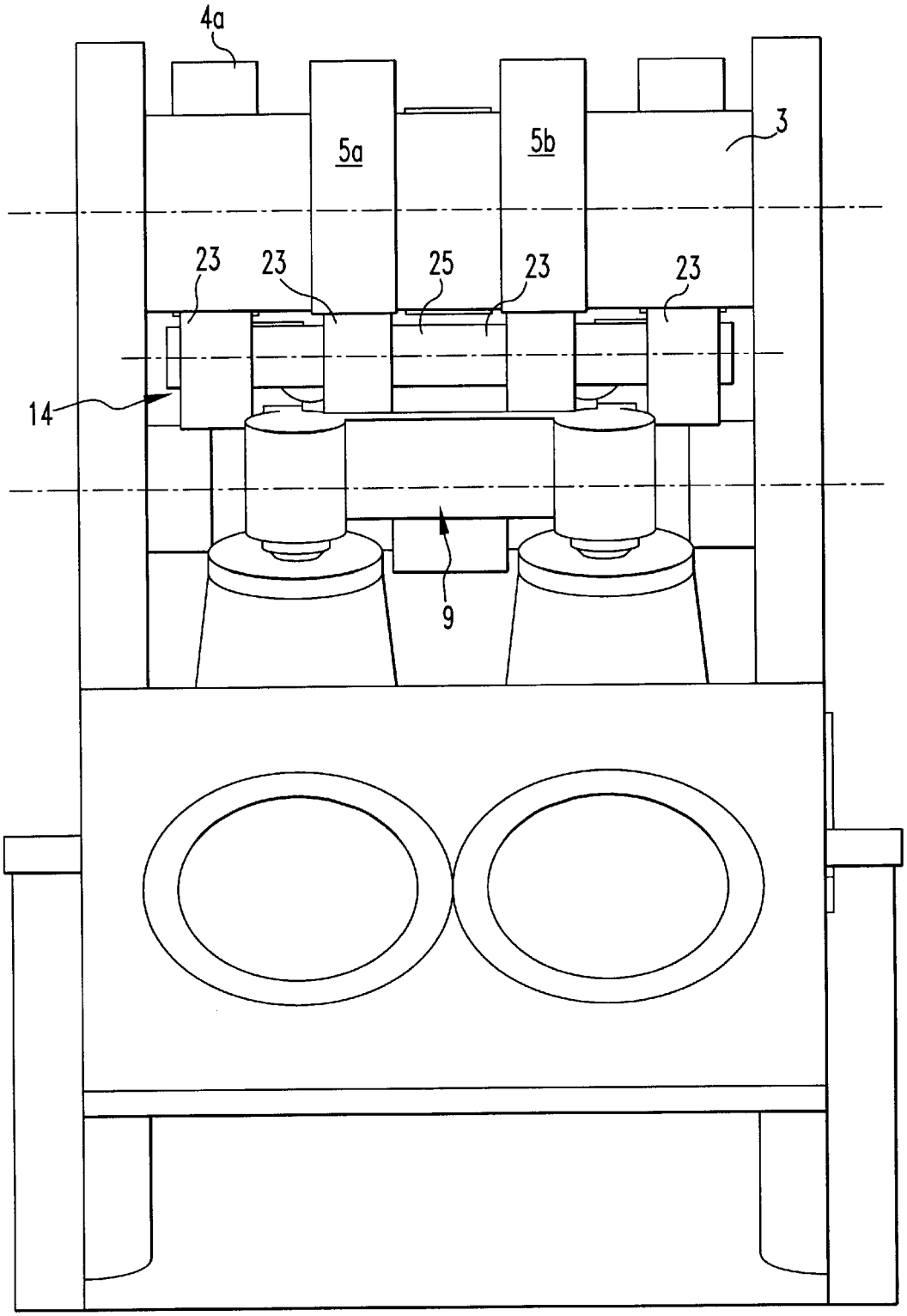
FIG. 5 shows the intake side of the cylinder head.

As shown in FIGS. 4 and 5, four rollers 23 are disposed on the roller shaft 25 of the engagement structure 14 corresponding to the number of intake cams. The two inner rollers 23 cooperate with the intake valve closing cams 5*a*, 5*b* on the second camshaft 3 and the two outer rollers 23 cooperate with the inlet valve opening cams 4*a*, 4*b* on the first camshaft 2. The engagement structure 14 is subjected to forces provided by the spring elements 15*a*, 15*b* to cause the engagement thereof with the intake valve opening and closing cams. The shaft 27 whose longitudinal axis is at the same time the pivot axis 13 for the intake valve operating lever 9 and for the exhaust valve operating lever 10 also carries the support elements 26*a*, 26*b* on which the spring elements 15*a*, 15*b* are supported.

The intake valve operating lever 9 is essentially U-shaped and comprises two legs 34*a*, 34*b* which extend parallel to the center plane 20 and a transverse web 35. The operating sections 9*a*, 9*b* which are about cylindrical in shape and which serve to operate the intake valves 7*a*, 7*b* are formed at the jointures between the two legs 34*a*, 34*b* and the transverse web 35. At their free ends, the two legs 34*a*, 34*b* are provided with bearing structures by way of which the intake valve operating lever 9 is pivotally supported on the shaft 27. The double bearing arrangement and the symmetrical arrangement of the intake valve operating lever 9 with respect to the center plane 20 reduce the forces to which the lever is subjected, that is, particularly no torsion forces in a plane including the pivot axis of the lever are effective. The legs 34*a*, 34*b* form telescopic slide members for the engagement structure 14 whose roller shaft 25 is disposed on the legs 34*a*, 34*b* in the areas between the outer and the inner rollers 23.

Figure 6:
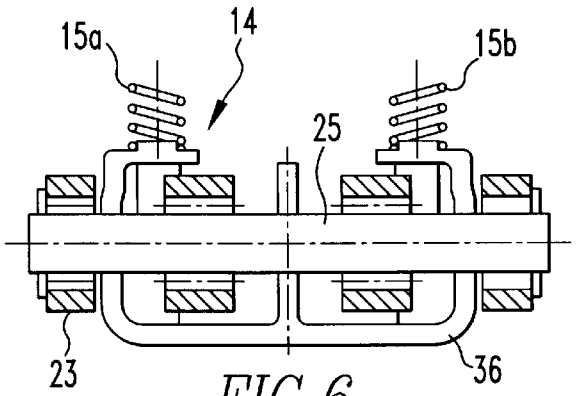
FIG. 6 is a cross-sectional view of a force transfer structure.

FIG. 6 shows the engagement structure 14 in cross-section. The engagement structure 14 includes, in addition to the rollers 23 on the roller shaft 25, also a slide carrier 36 which supports the roller shaft 25 and which is engaged by the spring elements 15*a*, 15*b*.

Figure 7:
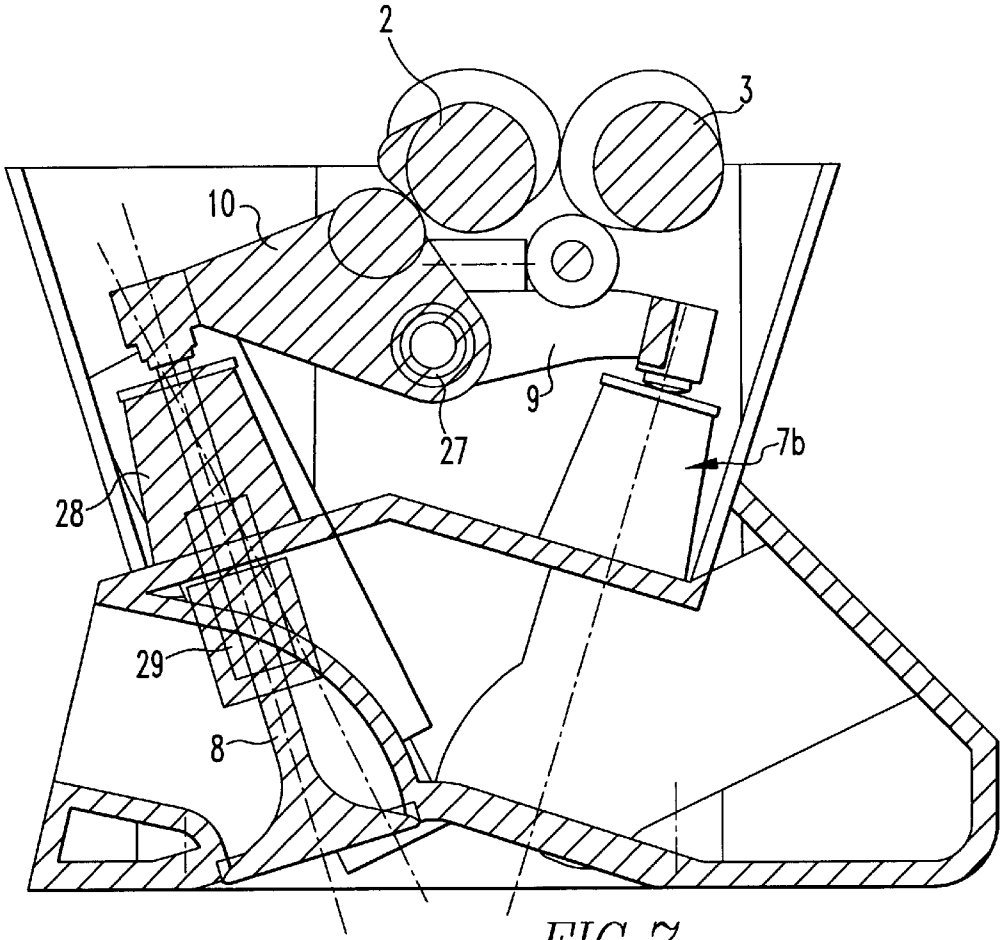
FIG. 7 is a cross-sectional view taken along line VII—VII of FIG. 3.

From the cross-sectional view of FIG. 7, it can be seen that the cams on the camshafts 2 and 3 operate the intake and exhaust valve operating levers 9 and 10 supported on the shaft 27. The movement is transmitted by the operating levers to the intake and exhaust valves. It is shown as an example for the exhaust valve 8 that the valve is guided in a valve guide 29 and is biased by a valve spring 28 in a valve closing direction.

Figure 8:
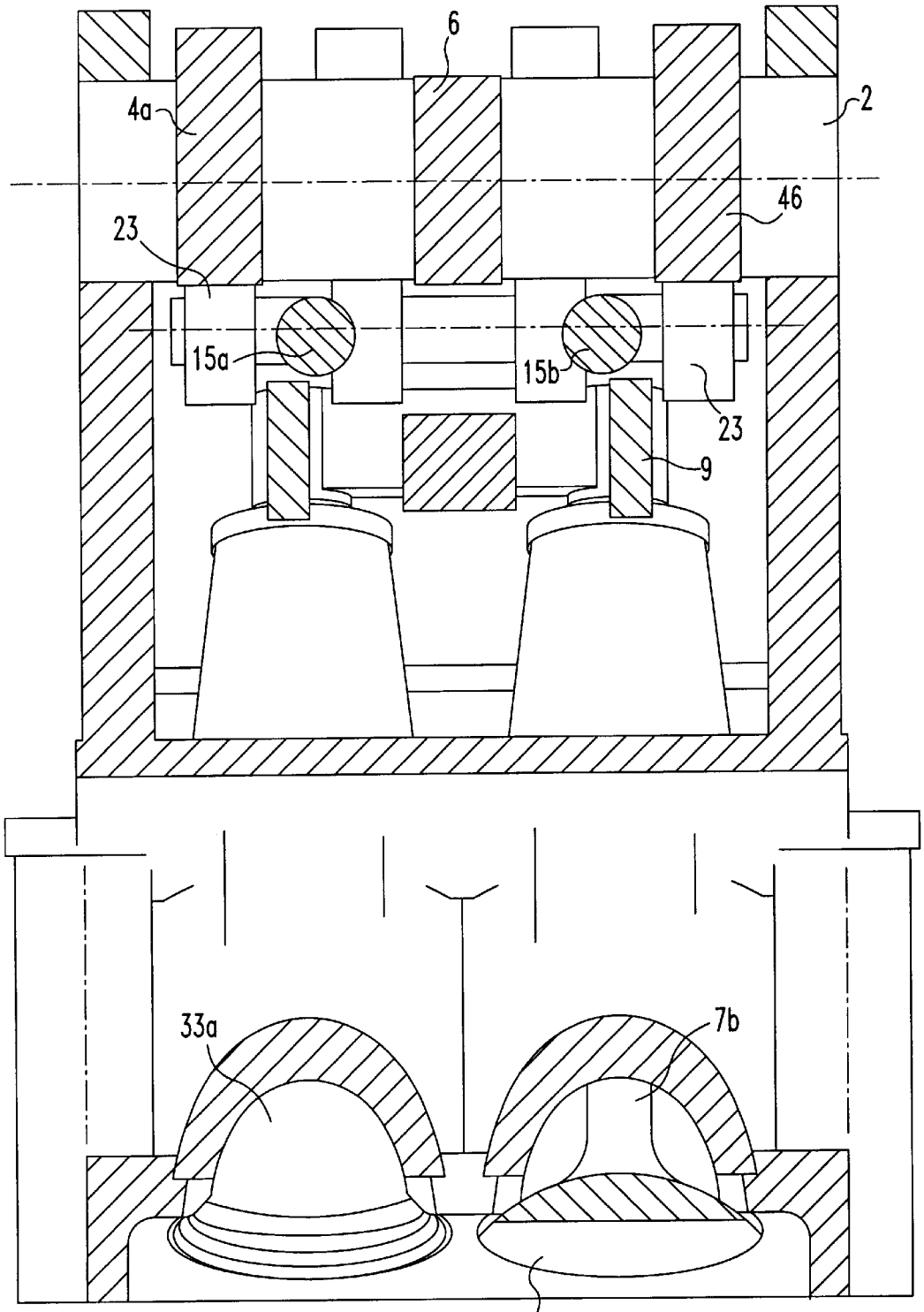
FIG. 8 is a cross-sectional view taken along line VIII—VIII of FIG. 3.

As shown in FIG. 8, the intake valve opening cams 4*a*, 4*b* which are disposed on the camshaft 2 are in contact with the outer rollers 23 of the engagement structure 14, which is biased by the spring elements 15*a*, 15*b* into engagement with the cams. The control movement is transmitted by way of the intake valve operating lever 9 to the intake valves. In FIG. 2, the first intake passage 33*a* is shown without an intake valve and the second intake passage 33*b* is shown with an intake valve 7*b*.

Figure 9:
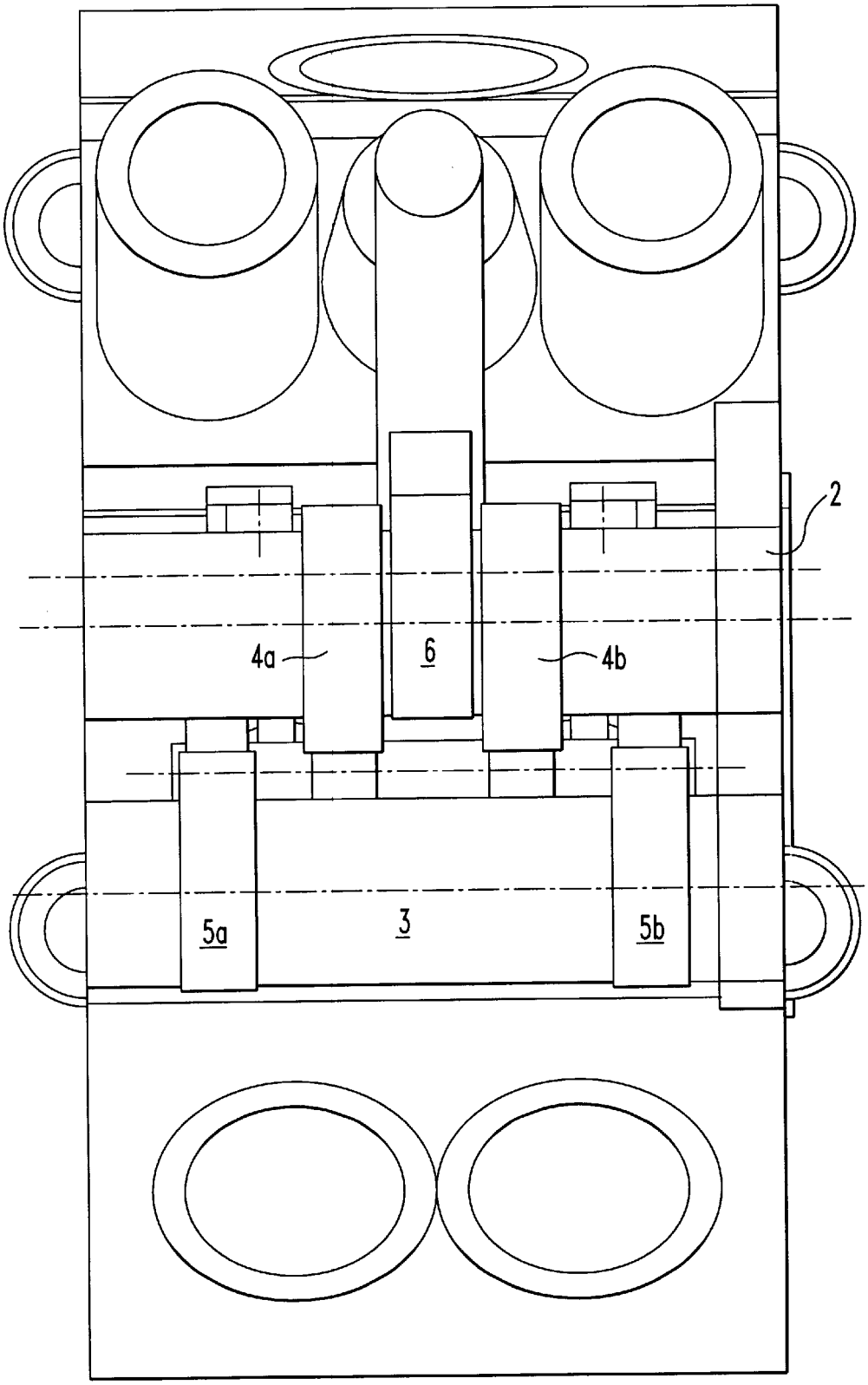
FIG. 9 is a top view of another embodiment of the invention.
Figure 10:
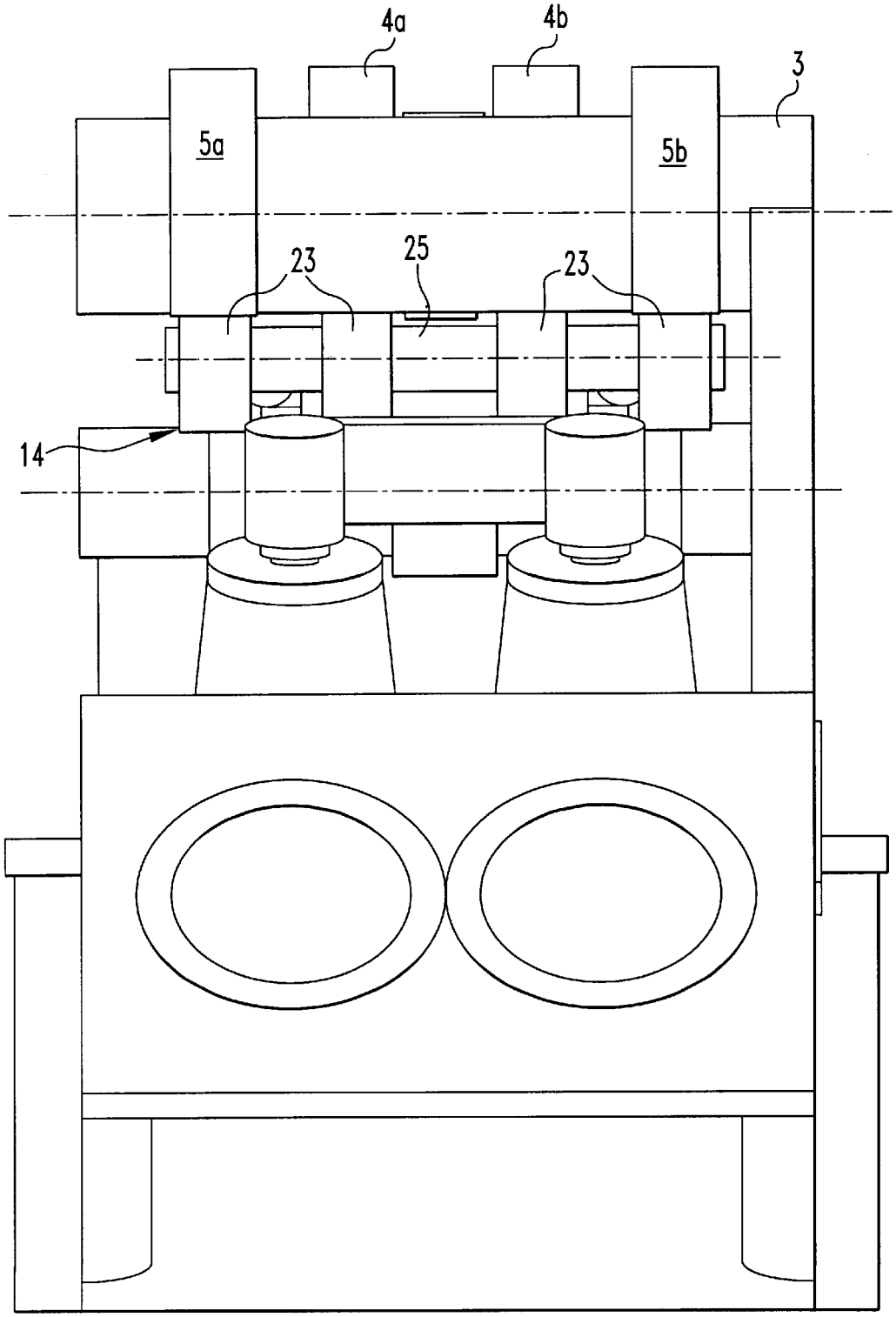
FIG. 10 is a top view of the intake side of the arrangement according to FIG. 9.

FIGS. 9 and 10 show a different embodiment. In this arrangement, the position of the intake cams is reversed in the direction of the longitudinal axis of the camshafts. The intake valve opening cams 4*a*, 4*b* are arranged on the camshaft 2 directly beside the central exhaust cam 6 so that only a small gap remains between the exhaust cam and the intake valve opening cam. The intake valve closing cams 5*a*, 5*b* on the second camshaft 3 are arranged at a relatively large axial distance from the exhaust cam 6. In the longitudinal direction of the camshafts from the axially outer ends to the center, there are the intake valve closing cams 5*a*, 5*b* on the second camshaft 3, then the intake valve opening cams 4*a*, 4*b* on the first camshaft 2 and in the center, the exhaust cam 6 on the first cam shaft 2.

In a reversed arrangement of intake valve opening and intake valve closing cams, the outer rollers 23 of the engagement structure 14 are in contact with the outer intake valve closing cams 5*a*, 5*b*. The inner rollers 23 of the engagement structure 14 are in contact with the inner intake valve opening cams 4*a*, 4*b*.

Because of the advantageous force conditions and the compact arrangement, the exhaust and intake valve operating levers may consist of a light material such as aluminum.

What is claimed is:

1. An arrangement for the variable control of the valves of an internal combustion engine with two intake valves and an outlet valve per cylinder, comprising: a cylinderhead, a first camshaft mounted on said cylinder head and including intake valve opening cams for controlling the opening of the intake valves and exhaust cams for controlling the exhaust valves, a second camshaft mounted on said cylinder head and including inlet valve closing cams for controlling the closing of said intake valves, an inlet valve operating lever arrangement pivotally supported on said cylinder head for operation by said intake valve opening cams to open said intake valves and by said intake valve closing cams for closing said intake valves, an exhaust valve operating lever pivotally mounted on said cylinder head for operation by said exhaust cam and a device for changing the phase position of said two camshafts relative to each other for controlling the opening duration of said intake valves, said first camshaft having said exhaust cam arranged in a central plane above said cylinder head and having said intake valve opening cams arranged at opposite sides of said exhaust cam, said second cam shaft having for each cylinder two intake valve closing cams arranged at opposite sides of the plane receiving said exhaust cam, said inlet valve operating lever arrangement being U-shaped with two legs pivotally supported on a valve operating lever support shaft and said exhaust valve operating lever being also pivotally supported on said valve operating lever support shaft between said two legs of said intake valve operating lever arrangement.

2. An arrangement according to claim 1, wherein said intake valve closing cams are arranged, in the direction of the longitudinal axis of said camshafts, between the exhaust cam and the two inlet valve opening cams.

3. An arrangement according to claim 1, wherein said intake valve opening cams are arranged, in the direction of the longitudinal axes of said camshafts, between said exhaust cam and said two intake valve closing cams.

4. An arrangement according to claim 1, wherein an engagement structure is disposed between said intake valve opening and closing cams and spring elements are provided for biasing said engagement structure into contact with said intake valve opening and closing cams.

5. An arrangement according to claim 4, wherein said engagement structure includes a roller shaft and, for each of said intake valve opening and closing cams, a roller to be contracted by a respective intake valve opening or closing cam.

* * * * *